United States Patent [19]

Monroe et al.

[11] 4,037,357

[45] July 26, 1977

[54] JUMPING TOY

[76] Inventors: Henry T. Monroe; William H. Peebles, Jr., both of 35 N. 63rd St., Philadelphia, Pa. 19139

[21] Appl. No.: 675,349

[22] Filed: Apr. 9, 1976

[51] Int. Cl.[2] ..... A63H 11/06

[52] U.S. Cl. ..... 46/129; 46/119; 46/130

[58] Field of Search ..... 46/119, 129, 130, 133, 46/145, 86 A–86 C, 86 R; 273/129 C, 129 R

[56] References Cited

U.S. PATENT DOCUMENTS 3,452,473 7/1969 Convertine ..... 46/119

*Primary Examiner*—Louis G. Mancene

*Assistant Examiner*—Mickey Yu

*Attorney, Agent, or Firm*—Joel Halpern

[57] ABSTRACT

A jumping toy includes a base member which is surmounted by a simulated animal or insect. A clockwork is connected through a gear train with a movable shaft which carries a spring-biased thrust rod. The movable shaft mounts a gear which is maintained in engagement with a fixed gear rack. Activation of the clockwork urges the thrust rod against the bias of the spring, and another gear carried by the movable shaft is cyclically engaged and disengaged by a sector gear and caused cyclical oscillation of the thrust rod and the development of sufficient force against a support surface to cause the toy to jump upwardly of the surface.

6 Claims, 3 Drawing Figures

JUMPING TOY

BACKGROUND OF THE INVENTION

This invention relates to jumping toys and more particularly to jumping toys which include a spring-containing base and the representation of an animal or insect mounted thereon.

Jumping toys of the charater described have been available for many years heretofore. However, the construction and interrelationship of the movable elements, principally of the elements involved in the cyclical development of the thrust force, has either been unduly frail so as to impart only a limited degree of operational durability to the toy or the toy was incapable of developing any substantial degree of thrust force.

SUMMARY OF THE INVENTION

One object of the present invention is the provision of a jumping toy which is capable of developing a substantial thrust force.

Another object of the present invention is the provision of a jumping toy which is capable of enhanced operational longevity.

Other objects and advantages of the invention will become readily apparent from the following description of the invention.

According to the present invention there is provided a jumping toy comprising in combination:

- a base member having side walls and a bottom wall and a simulated animal or insect mounted thereon;
- a first shaft mounted rotatably in said base member;
- a coil spring mounted upon said first shaft and adapted to be wound thereon;
- a gear train operatively connected to said coil spring and including a sector gear;
- said bottom wall of said base member having an aperture therein;
- a thrust spring-biased thrust rod mounted for vertical oscillation within said base member in vertical alignment with said aperture;
- a movable shaft mounted within said base member for oscillation together with said thrust rod;
- first gear means carried by said movable shaft engageable with and drivable by said sector gear;
- a gear rack mounted fixedly within said base member;
- and second gear means carried by said movable shaft maintained in meshing engagement with said gear rack;
- whereby upon winding of said coil spring and activation of same said sector gear drives said gear means and effects rotation of the movable shaft and the climbing of said gear rack by said second gear means against the spring bias, the cyclical engagement and disengagement of said sector gear and first gear means of said movable shaft causing cylcical oscillation of said thrust rod and the periodic development of a force against a supporting surface for said toy sufficient to propel the toy away from said supporting surface.

BRIEF DESCRIPTION OF THE DRAWINGS

In order that the invention may be more fully understood it will now be described, by way of example, with reference to the accompanying drawing in which.

DETAILED DESCRIPTION OF THE INVENTION

Figure 1:
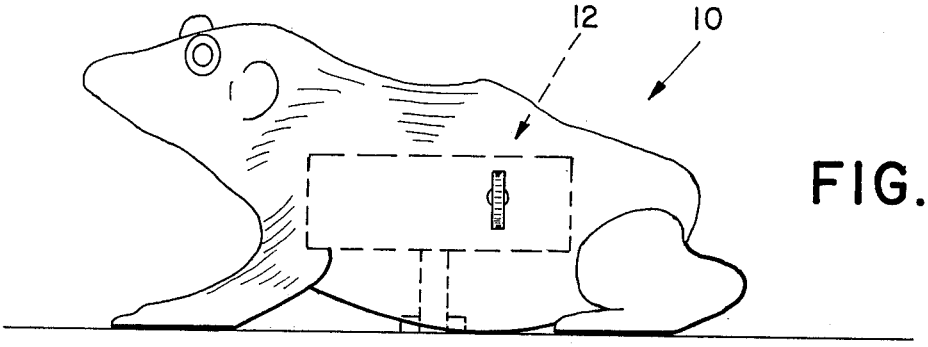
FIG. 1 is a side elevation of a jumping toy embodying the invention.

Referring to the drawing there is shown a jumping toy indicated generally at 10. As depicted the representation is that of a frog. It will be understood, however, that the representation may be that of any animal whose ambulatory movement is accomplished by jumps or hops such as a frog, kangaroo, bird or the like or that of an insect capable of similar movement such as a grasshopper.

The toy is provided with a base member 12 which houses the thrust force-developing mechanism to be described hereafter. Such base member may either be incorporated within the body structure of the animal or the representation of the animal or insect may surmount the base member. Securing of the base member to the simulated animal or insect may be accomplished in any conventional manner and, therefore, the present specification will not be unnecessarily encumbered with the details of such construction.

Figure 2:
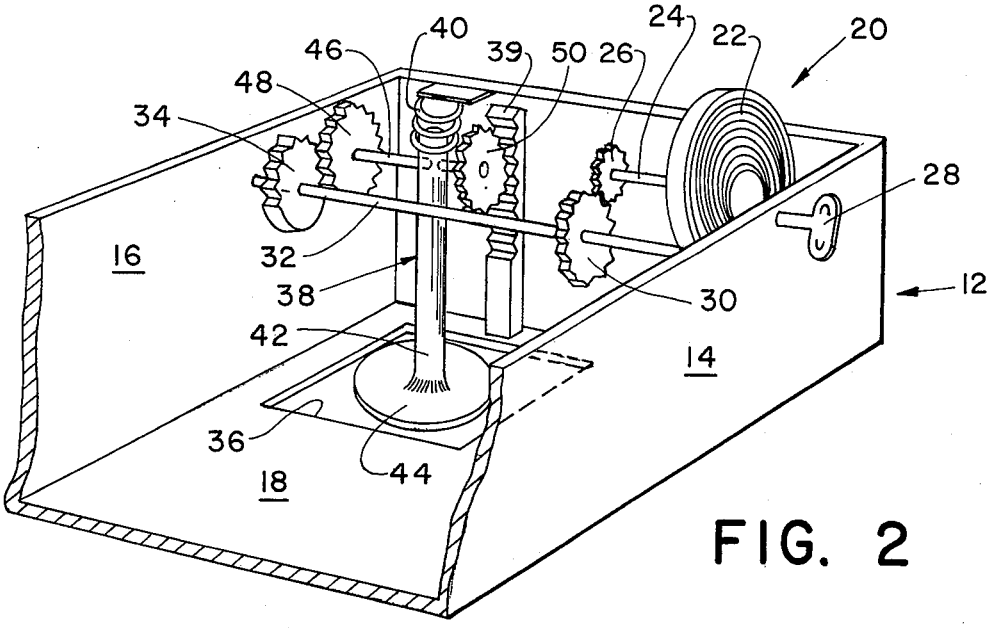
FIG. 2 is a perspective view of a base member and the movable thrust force-developing elements.

The construction of FIG. 2 will first be described, and it will be seen that the base member 12 includes side walls 14, 16 and bottom wall 18. A clockwork mechanism 20 is mounted in the base member which includes a windable coil spring 22 mounted upon a shaft 24. The shaft is journalled in one of the side walls and carries fixedly thereon a pinion 26. A key member 28 is opertively connected to the shaft and may be manually operated to wind coil spring 22. A gear train is operatively connected to the coil spring and, as depicted in FIG. 2, may include the pinion 26 and a gear 30 engageable therewith and drivable by the pinion. Gear 30 is mounted upon a shaft 32 which is desirably parallel to shaft 24. A sector gear 34 is carried by shaft 32 in spaced relation to gear 30. The bottom wall of the base member is provided with an aperture 36 for a purpose to be hereafter described.

Carried fixedly within the base member, such as by securement to one of the side walls thereof, is a gear rack 39. Supported also within the base member is a thrust spring 40. The spring may be fixed to a bracket (not shown) mouned on one of the side walls or in any conventional manner. However, the spring should be so mounted that it is in axial alignment with the opening 36 in the bottom wall 18 for a reason to be explained.

A thrust rod 38 is mounted within the base member for oscillation vertically therein. Preferably the thrust rod includes an elongated stem 42 and an enlarged base 44. The enlarged base is so dimensioned and configured so as to be able to oscillate through aperture 36 in the bottom wall and to make contact with a supporting surface for the toy.

A movable shaft 46 is positioned within the base member in parallel relation to shaft 32. A pair of gear members 48, 50 are carried by shaft 46. A first of such gears is positioned and designed so as to be engageable with and be driven by sector gear 34. Thus, upon rotation of the shaft carrying the sector gear, through activation of the coil spring 22, when gears 48 and 34 are in meshed engagement, movable shaft 46 is rotated. Gear 50 is positioned upon the shaft such that it is maintained in meshed engagement with the gear rack 39. Therefore, as shaft 46 is rotated gear 50 will ride up or climb the gear rack. The thrust rod 38 is given a transverse bore through which shaft 46 extends. The upward movement of gear 50 and of shaft 46 thus also raises the thrust rod. Spring 40, which is preferably a compression spring, is positioned with respect to the stem of the thrust rod such that a biasing force is normaly exerted on the thrust rod urging it towards aperture 36. When the thrust rod is raised it thus acts against such biasing force of the spring. The upward movement of the shaft 46 and its gears and of the thrust rod continues while gear 48 remains in meshed relation with the toothed segment of sector gear 34. However, when shaft 32 is rotated sufficiently to effect a disengagement between the teeth of the sector gear and those of gear 48 a clearance will exist between the outer circle diameter of gear 48 and the surface of the nontoothed segment of the sector gear. At such time the force of spring 40 will propel the assembly of shaft 46, gears 48 and 50 and thrust rod 38 downwardly. The enlarged end of the thrust rod passes through aperture 36 and engages with the surface (not shown) supporting the toy. A force is then developed which pushes the toy off the supporting surface and into the air. In the event the toy is to be propelled both forwardly and upwardly the orientation of the thrust rod with respect to the supporting surface can be suitably adjusted so as to provide for a force component in the horizontal direction. The construction for achieving such a combined upward and forward thrust need not be described herein since many variations in design can readily be determined by a skilled designer without departing from the scope of the present invention.

It will be appreciated that shaft 46 may be wholly supported by means of a bushing within the bore of the thrust rod or one or both ends of the shaft may be supported in sidewalls and/or in interior partitions (not shown) within the base member. The shaft 46, however, should be free to rotate easily.

Figure 3:
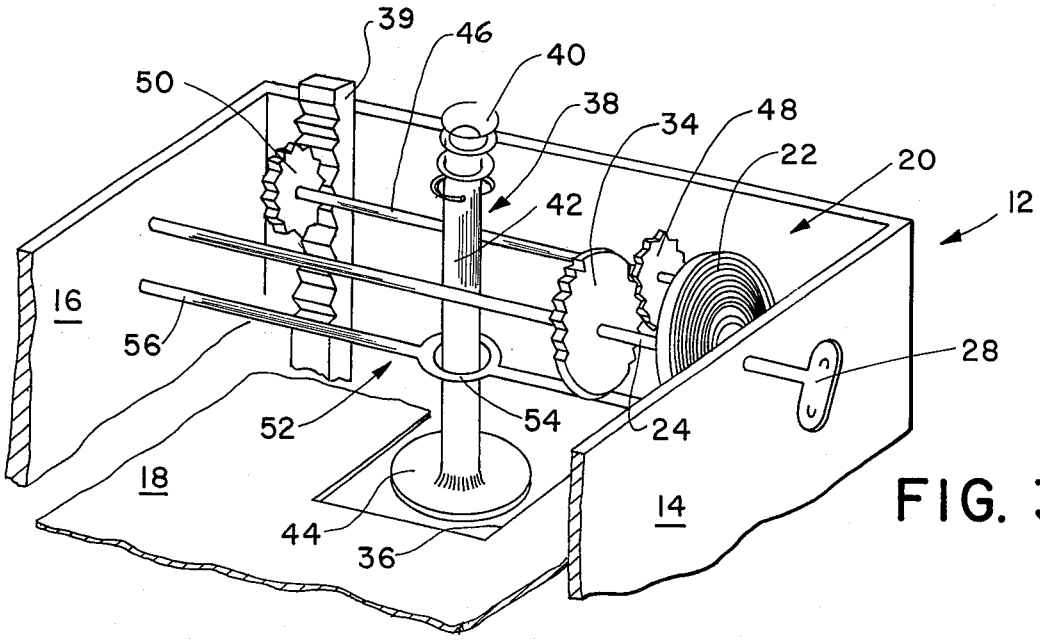
FIG. 3 is an enlarged perspective view of a second embodiment of the movable thrust force-developing elements.

In order to assist in maintaining the path of movement of thrust rod 38 as nearly vertical as possible a thrust rod retaining and guiding member 52, as may be seen most clearly in FIG. 3, may be provided. The retaining and guiding member is shown as including a ring element 54, which loosely encircles the stem of the thrust rod, and a rod element 56 which has its opposed ends secured to the side walls of the base member.

The modification illustrated in FIG. 3 is essentially the same as that of FIG. 2 in providing the clockwork mechanism 20 and a sector gear 34 driven thereby for driving of the gear 48. However, it will be observed that sector gear 34 is mounted directly upon the shaft which carries coil spring 22. Thus, pinion 26 and the additional shaft 24 are not required. Also, gear rack 39 is positioned closely adjacent a corner of the base member and gear 50 is carried at the end of the extended shaft for engagement therewith.

It will, of course, be understood that the shaft carrying the sector gear in either of the embodiments illustrated in FIGS. 2 and 3 is preferably journalled for rotation in the opposed side walls, of the base member.

From the foregoing it will be appreciated that through appropriate selection of the gear ration between the clockwork mechanism and the gear train and by appropriate design of the sector gear with its toothed and non-toothed portions one can provide for any predetermined oscillatory cycle for the thrust rod. Selection of the spring constant for spring 40 will be primarily determinative of the thrust force developed to propel the toy in its vertical or combined vertical and horizontal trajectory. It has been found, for example, that a gear ratio between pinion 26 and gear 30 of 2:1 is advantageous. It has also been found desirable to provide a bearing within the bore of the thrust rod to facilitate rotation of shaft 46 therewithin.

A jumping toy has thus been provided which is sturdy, capable of substantial operational longevity, and which can develop substantial thrust force.

I claim:

1. A jumping toy comprising, in combination:

a base member having side walls and a bottom wall and a simulated animal or insect mounted thereon;

a first shaft mounted rotatably in said base member;

a coil spring mounted upon said first shaft and adapted to be wound thereon;

a gear train operatively connected to said coil spring and including a sector gear;

said bottom wall of said base member having an aperture therein;

a thrust spring-biased thrust rod mounted for vertical oscillation within said base member in vertical alignment with said aperture;

a movable shaft mounted within said base member for oscillation together with said thrust rod; first gear means carried by said movable shaft engageable with and drivable by said sector gear;

a gear rack mounted fixedly within said base member;

and second gear means carried by said movable shaft maintained in meshing engagement with said gear rack;

whereby upon winding of said coil spring and activation of same said sector gear drives said gear means and effects rotation of the movable shaft and the climbing of said gear rack by said second gear means against the spring bias, the cyclical engagement and disengagement of said sector gear and first gear means of said movable shaft causing cyclical oscillation of said thrust rod and the periodic development of a force against a supporting surface for said toy sufficient to propel the toy away from said supporting surface.

2. A jumping toy according to claim 1 including a pinion carried fixedly by said first shaft, a second shaft mounted rotatably in said base member in parallel relation to said first shaft, third and fourth gear means carried by said second shaft, said third gear means being drivable by said pinion and said fourth gear means being said sector gear, said thrust spring is a compression spring mounted in said base member adapted to urge said thrust rod through said aperture, said thrust rod having a bore extending transversely therethrough, and said movable shaft mounted rotatably within said bore.

3. A jumping toy according to claim 1, wherein said thrust rod includes an elongated stem and an enlarged base dimensioned to oscillate through the aperture in the bottom wall of said base member.

4. A jumping toy according to claim 3, wherein a thrust rod retaining and guiding member is mounted within said base member and includes a rod element and a ring element, said retaining and guiding member being so mounted that the stem of said thrust rod extends through said ring element and is thereby guided in its vertical oscillations.

5. A jumping toy according to claim 1, wherein the diameter of the non-toothed segment of said sector gear is less than the outside circle diameter of said first gear means whereby upon disengagement of said sector and first gears said movable shaft, under the influence of said thrust spring, can move downwardly and said first gear can be urged past said sector gear.

6. A jumping toy according to claim 1, wherein said sector gear is carried fixedly by said first shaft, said movable shaft being mounted in parallel relation to said first shaft, a compression spring mounted in said base member adapted to urge said thrust rod through said aperture, said thrust rod having a bore extending transversely therethrough, and said movable shaft mounted rotatably within said bore.

* * * * *